US006898910B2

(12) United States Patent
Bellino, Jr.

(10) Patent No.: US 6,898,910 B2
(45) Date of Patent: May 31, 2005

(54) PRECAST COMPOSITE HEADER JOINT SYSTEM AND A METHOD FOR FORMING AND INSTALLING THE SAME

(76) Inventor: Frank Bellino, Jr., 22 Wallabuc River La., South Salem, NY (US) 10590

( * ) Notice: Subject to any disclaimer, the term of this patent is extended or adjusted under 35 U.S.C. 154(b) by 3 days.

(21) Appl. No.: 10/357,850

(22) Filed: Feb. 4, 2003

(65) Prior Publication Data

US 2004/0154247 A1 Aug. 12, 2004

(51) Int. Cl.[7] ..... E04B 1/62

(52) U.S. Cl. ..... 52/393; 52/102; 52/396.02; 52/742.14; 264/35

(58) Field of Search ..... 52/393, 396, 742.14, 52/745.19, 745.2, 174, 175, 396.05, 573.1, 102, 396.02; 264/35, 261, 271.1, 279

(56) References Cited

U.S. PATENT DOCUMENTS 3,694,533 A * 9/1972 Kelsey ..... 264/511
3,751,864 A * 8/1973 Berger et al. ..... 52/79.11
3,853,976 A * 12/1974 Kelsey ..... 264/511
4,220,489 A * 9/1980 Coplan et al. ..... 156/73.6
4,338,758 A * 7/1982 Hagbjer ..... 52/745.2
4,604,841 A * 8/1986 Barnoff et al. ..... 52/174
4,695,031 A * 9/1987 Proctor ..... 249/91
4,804,292 A * 2/1989 DeLuca ..... 404/69
5,072,570 A * 12/1991 Johnson ..... 52/747.1
5,609,005 A * 3/1997 Schierloh et al. ..... 52/699
6,018,918 A * 2/2000 Long, Sr. ..... 52/408
6,058,671 A * 5/2000 Strickland ..... 52/580
6,115,980 A * 9/2000 Knak et al. ..... 52/396.04
6,449,914 B1 * 9/2002 Horstketter et al. ..... 52/393
6,481,172 B1 * 11/2002 Porter ..... 52/506
6,584,740 B2 * 7/2003 Record ..... 52/270

* cited by examiner

*Primary Examiner*—Peter M. Cuomo
*Assistant Examiner*—Erika Garrett
(74) *Attorney, Agent, or Firm*—Morgan & Finnegan, LLP

(57) ABSTRACT

The invention disclosed relates to a precast composite header joint system and method for forming and installing the same in a concrete deck structure. According to the invention, the header is cast and cured before being positioned and secured in a recess formed in one of the concrete slabs. A viscous bonding agent is then poured into the void spaces between the header and the concrete slab recess. The bonding agent cures and forms a solid material which fills all of the space between the header and the concrete slab recess. Adjacent headers installed in opposing concrete slab recesses are coupled together by a joint to provide a continuous deck structure.

41 Claims, 7 Drawing Sheets

FIG. 7

ILLUSTRATIVE SUB-COMBINATIONS AND VARIATIONS OF PRE-CAST COMPOSITE JOINT SYSTEM

| PRE-CAST HEADER MATERIAL | NOSING TYPE | EXPANSION/CONTRACTION JOINT MATERIAL |
|---|---|---|
| DP Concrete | Armored Steel Angle | Compression Seal (DS Brown™) |
| DP Concrete | Armored Steel Angle | Polymer Modified Concrete (MATRIX™) |
| DP Concrete | Polymer Concrete (T-17) | Silicone Sealant (DOW 902™) w/ Backer Rod |
| DP Concrete | Elastomeric Concrete (Wabocrete™) | Silicone Sealant (Wabocrete Siliconeseal™) with Backer Rod |
| HP Concrete | Armored Steel Angle | Compression Seal (DS Brown™) |
| HP Concrete | Armored Steel Angle | Polymer Modified Concrete (MATRIX™) |
| HP Concrete | Polymer Concrete (T-17) | Silicone Sealant (DOW 902™) w/ Backer Rod |
| HP Concrete | Elastomeric Concrete (Wabocrete™) | Silicone Sealant (Wabocrete Siliconeseal™) with Backer Rod |
| Elastomeric Concrete (Wabocrete™) | No Nosing (Header itself is the nosing) | Silicone Sealant (Wabocrete Siliconeseal™) with Backer Rod |
| Elastomeric Concrete (Wabocrete™) | Armored Steel Angle | Compression Seal (DS Brown™) |
| Elastomeric Concrete (Wabocrete™) | Armored Steel Angle | Polymer Modified Concrete (MATRIX™) |
| Polymer Concrete (T-17) | No Nosing (Header itself is the nosing) | Silicone Sealant (DOW 902™) w/ Backer Rod |
| Polymer Concrete (T-17) | Armored Steel Angle | Compression Seal (DS Brown™) |
| Polymer Concrete (T-17) | Armored Steel Angle | Polymer Modified Concrete (MATRIX™) |

PRECAST COMPOSITE HEADER JOINT SYSTEM AND A METHOD FOR FORMING AND INSTALLING THE SAME

FIELD OF THE INVENTION

The present invention relates to the construction and repair of concrete deck structures such as elevated highways, bridges, parking decks and other applications where concrete slabs are connected by expansion/contraction joints.

BACKGROUND OF THE INVENTION

Many types of concrete deck structures include expansion/contraction joints between abutting front and rear surfaces of adjacent concrete slabs to provide a continuous deck structure. However, stresses imparted on the deck structure often bring about erosion of the concrete in the immediate vicinity of the joint due to cracking, edge failure and faulting. In order to avoid the need to replace an entire length of concrete slab having damaged edges, many concrete deck structures include a foot wide replaceable composite concrete header at the front and rear ends of each concrete slab.

One method presently used for the construction of concrete deck structures involves pouring and forming the concrete headers in situ on top of the existing deck and in front and rear ends of each concrete slab. Typically, the upper edge of each header adjacent the expansion and compression joint is fitted with a steel angle to protect the concrete from eroding. The steel angle spans the entire width of the header and is mounted to the concrete slab by support angles. During curing, the concrete header bonds to the complementary surfaces of the concrete slab.

A procedure currently used to replace damaged concrete headers consists of removing the damaged header, cleaning and sandblasting the recessed surface of the concrete slab, mounting a steel angle to the concrete slab, pouring concrete into the recess formed in the concrete slab and thus forming the new header in situ.

However, there are significant drawbacks to these currently practiced procedures. First, concrete headers require up to seven days to cure. In order to use the concrete deck structure during this seven-day curing period, roadway steel plates must be placed over each concrete header to prevent deformation caused by automobiles, heavy construction equipment or other vehicles traveling on the deck structure. However, these roadway steel plates have been known to create hazardous conditions that can result in serious accidents when automobiles travel over the plates at excessive speeds.

Secondly, the replacement of damaged concrete joints is typically limited to off peak traffic periods, usually between the hours of 11 p.m. and 6 a.m. Therefore, the construction contractor must incur the added cost and inconvenience of obtaining an off hour supply of concrete to form the concrete headers in situ. Inclement weather conditions can also interfere.

Thus there exists a compelling need for a safe, efficient and cost-effective method for forming and installing concrete headers in concrete deck structures.

OBJECTS OF THE INVENTION

It is, therefore, a principal object of the present invention to provide a method for efficiently forming and installing concrete headers in concrete deck structures.

It is a further object of the present invention to provide a method for efficiently replacing damages concrete headers in existing concrete deck structures.

It is a further object of the present invention to provide a method for efficiently installing a joint system for concrete deck structures.

It is a further object of the present invention to provide a precast concrete header joint system for concrete deck structures.

These and other objects and advantages of the invention will become apparent hereon, or may be appreciated by practice with the invention, the same being realized and attained by means of instrumentalities, combinations and methods pointed out in the appended claims. Accordingly, the present invention resides in the novel parts, constructions, arrangements, improvements, methods and steps herein shown and described.

BRIEF DESCRIPTION OF THE INVENTION

In accordance with the present invention, a concrete header joint system for concrete deck structures and method for forming and installing the same are provided in which one or more concrete headers are precast and then installed in a concrete deck structure such as elevated highways, bridges, parking decks or any other applications where concrete slabs and expansion/compression joints are used.

The inventive method comprises precasting a concrete header, allowing the precast concrete header to cure, positioning the precast header in a recess formed in the concrete slab, including adjusting the height of the precast concrete header relative to the height of the top surface of the concrete deck structure to provide a level grade, securing the precast concrete header to the concrete slab and pouring a viscous bonding agent into all void spaces between the respective surfaces of the precast concrete header and the concrete slab.

Preferably, the inventive method includes securing the precast header to the concrete slab through one or more bolted connections. To this end the precast concrete header is formed with one or more bores that extend between the top and bottom surfaces of the header. Each such bore is dimensioned for receiving an anchor bolt. The precast concrete header further includes support steel clip angles spaced at intervals along the width of the bottom surface of the header. Each support clip angle includes an aperture that is axially aligned with one of the bores and dimensioned for receiving an anchor bolt. Each support clip angle preferably includes a steel tube that is axially aligned with the aperture and extends upwardly into the corresponding bore formed in the header. Thus, the aperture and metal tube of each support clip angle in conjunction with the corresponding bore in the header forms a continuous passageway in the precast header for receiving an anchor bolt. The precast header and concrete slab are secured by embedding one end of the anchor bolts in the concrete slab and extending the free end of each anchor bolt through a corresponding passageway formed in the header and bolting the precast header to the concrete slab.

The concrete header may also be formed with an armored top edge to prevent erosion of the concrete when the header is subject to the stresses imposed by automobiles, construction vehicles and the like. The armored edge may be formed by a steel angle that spans the length of the concrete header. This reinforced edge can also comprise a nosing formed of elastomeric or polymer concrete. The steel angle is mounted to the support clip angles formed in the precast header.

Alternatively, the steel angle and the support clip angles may be formed as a unitary piece which is mounted to the concrete slab.

The step of positioning the concrete header to provide a level grade with the top surface of the concrete deck structure may be carried out using one or more metal shim plates inserted beneath the header.

BRIEF DESCRIPTION OF THE DRAWINGS

The invention will be further described, by way of example, with reference to the accompanying drawings, wherein:

FIG. 7 includes a chart setting forth illustrative subcombinations of joint configurations and materials that are subject to the present invention.

DESCRIPTION OF A PREFERRED EMBODIMENTS

Referring generally to the embodiments of the invention shown in the accompanying drawings, wherein like reference numbers refer to like parts throughout the various views, the basic principles of the broadest aspects of the invention can be appreciated from FIGS. 1–4.

Figure 1:
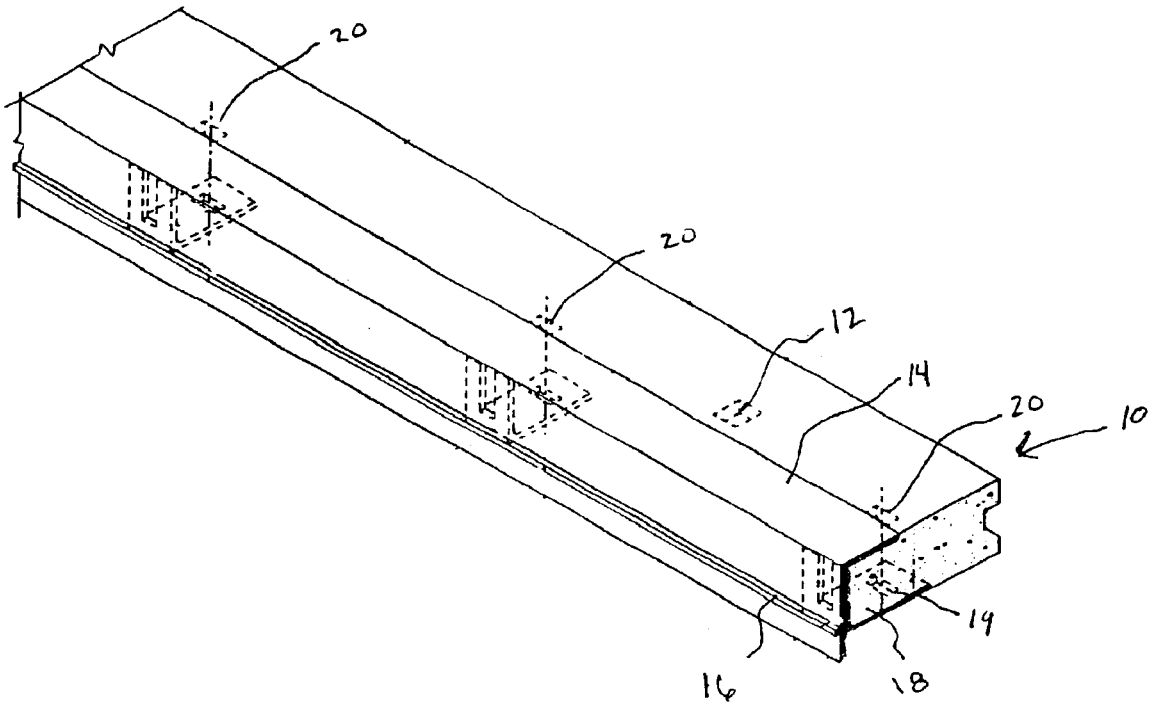
FIG. 1 is a perspective view of an embodiment of an armored concrete header formed according to a method of the present invention.

A preferred embodiment of the header (generally designated as 10) formed according to the present invention is illustrated in FIG. 1. As here embodied, the header is formed by pouring concrete into a casting form and allowing the concrete to cure prior to being installed in the concrete slab. It will be understood that the header is designed to be smaller than the generally rectangular-shaped recess in the concrete slab which receives the header. The method of the present invention involves positioning the header in the concrete slab recess such that the outer face of the header and the end of the concrete slab are aligned to form a generally continuous surface. Similarly, the top surface of the header is aligned with the upper surface of the concrete deck structure to provide a level grade. As explained in more detail below, any resulting gaps between the adjacent surfaces of the concrete slab recess and the header is subsequently filled with a viscous bonding agent which cures to form a solid material.

Figure 4:
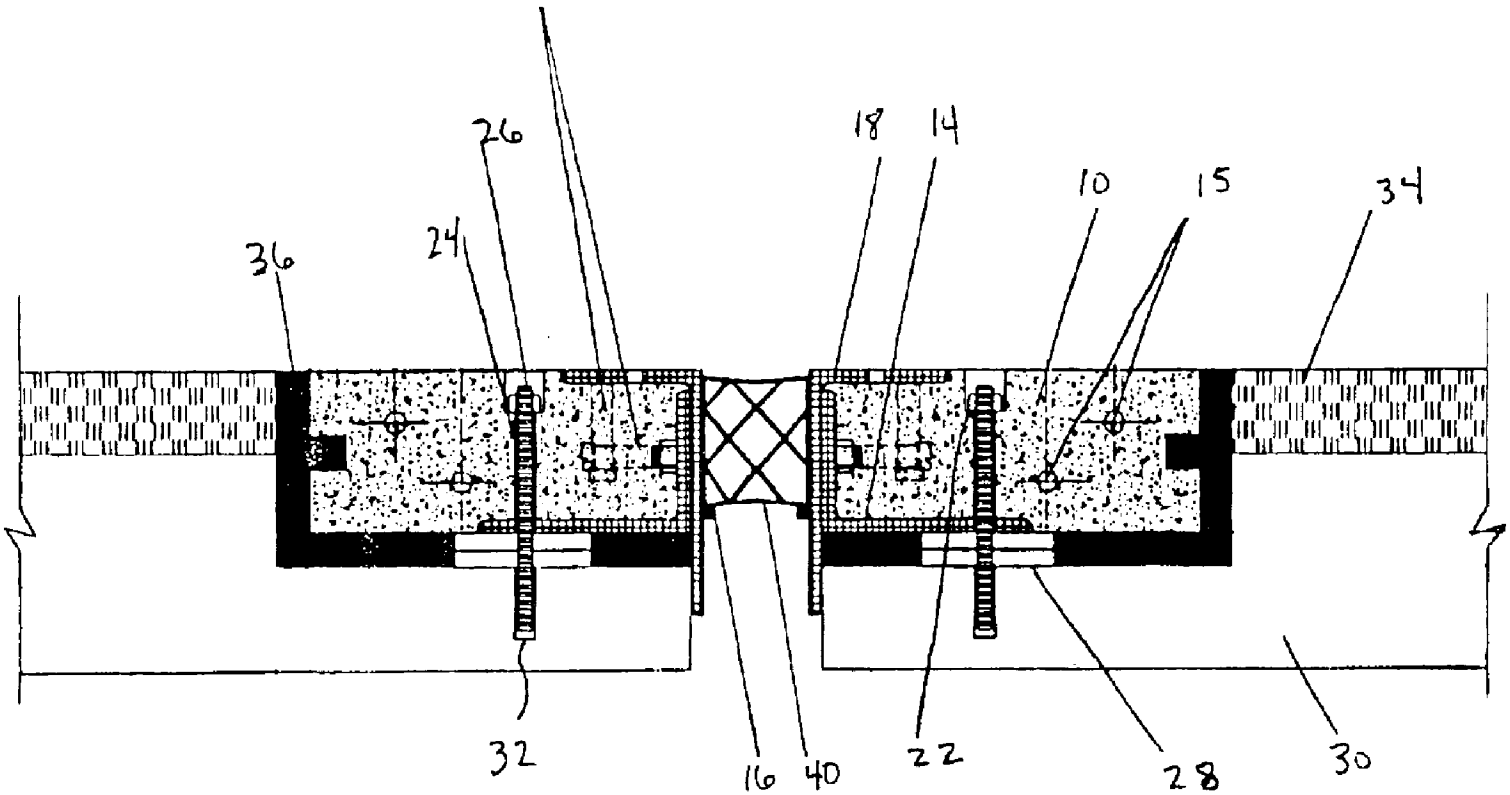
FIG. 4 is a cross-sectional view taken along section line 3—3 of FIG. 3.

In a preferred embodiment shown in FIG. 1, the header 10 is precast with a steel angle 14 to form an armored upper edge and outer face of the header. Steel angle 14 spans the entire length of the header and helps maintain the physical integrity of the header when subjected to the stresses imparted by vehicles traveling over the concrete deck structure. As shown in FIG. 4, the vertical portion of steel angle 14 extends beyond the bottom surface of the header to form a lip which abuts the end of concrete slab 30 when the header is secured in the recess of the concrete slab. This assures that the outer face of the header 10 is generally aligned with the end of the concrete slab 30. The outer face of steel angle 14 is also fitted with a bar 16 which functions with a corresponding bar 16 fitted on the outer face of an adjacent header to support and position compression seal 40 between abutting concrete slabs 30.

Referring to FIG. 1, the precast concrete header of the present invention preferably includes one or more support clip angles 18 aligned along the bottom and outer surfaces of concrete header 10. In the embodiment shown in FIGS. 1 and 4, the abutting vertical legs of steel angle 14 and support clip angles 18 are bolted together. It will be understood that precast header 10 may alternatively be fitted with a single unitary structure having the combined general configuration of steel angle 14 and support clip angles 18.

Referring to FIG. 1, header 10 is preferably formed with two lifting inserts 12 recessed into the top surface of the header. These lifting inserts include steel hooks (not shown) which can be engaged to facilitate moving the header during transportation and installation. Referring now to FIG. 4, header 10 is also preferably formed with one or two reinforcement bars 15 which extend the entire length of the header. In addition, steel angle 14 preferably includes a series of anchor studs 17 which secure steel angle 14 to the concrete forming the body of header 10.

The method of the present invention involves securing the precast header to the underlying concrete slab. To this end, the header is cast to include at least one bore 20 which extends vertically through the header. The concrete header 10 shown in FIG. 1 includes three bores 20 spaced across the length of the header. Referring now to FIG. 4, each bore 20 consists of two interconnecting sections having different diameters. The upper section of bore 20 extends from an opening in the upper surface of header 10 to an annular shoulder 22. The lower section of bore 20 has a smaller diameter than the upper section and extends from shoulder 22 to an opening in the bottom surface of header 10. Each bore 20 is aligned with an aperture 19 formed in a separate support clip angle 18. Support clip angle aperture 19 has the same dimension and diameter as the lower section of bore 20. As shown in FIG. 4, each support clip angle 18 may include a metal tube 24 that extends upwardly from the horizontal leg of the support clip angle and is axially aligned with aperture 19. Metal tube 24 has an outer diameter dimensioned to fit within the lower section of bore 20 and has an interior diameter dimensioned to receive an anchor bolt 26.

Referring now to FIG. 4, the precast header 10 may be mounted to concrete slab 30 by positioning the header in the recess and drilling a separate hole 32 in the concrete slab for each bore 20 in header 10. Next, one end of an anchor bolt 26 is fixedly embedded in each of the holes 32 in the concrete slab 30.

Since the depth of each recess may vary for each concrete slab, the header may need to be raised to provide a level grade along the top surface of the concrete deck structure. The concrete deck structure illustrated in FIG. 4 includes an asphalt overlay 34. Accordingly, the header may need to be raised relative to the concrete slab such that the top surface of the header is level with the top surface of the asphalt overlay 34. To this end, one or more shim plates 28 may be inserted between the concrete slab and the bottom surface of the precast header.

Figure 2:
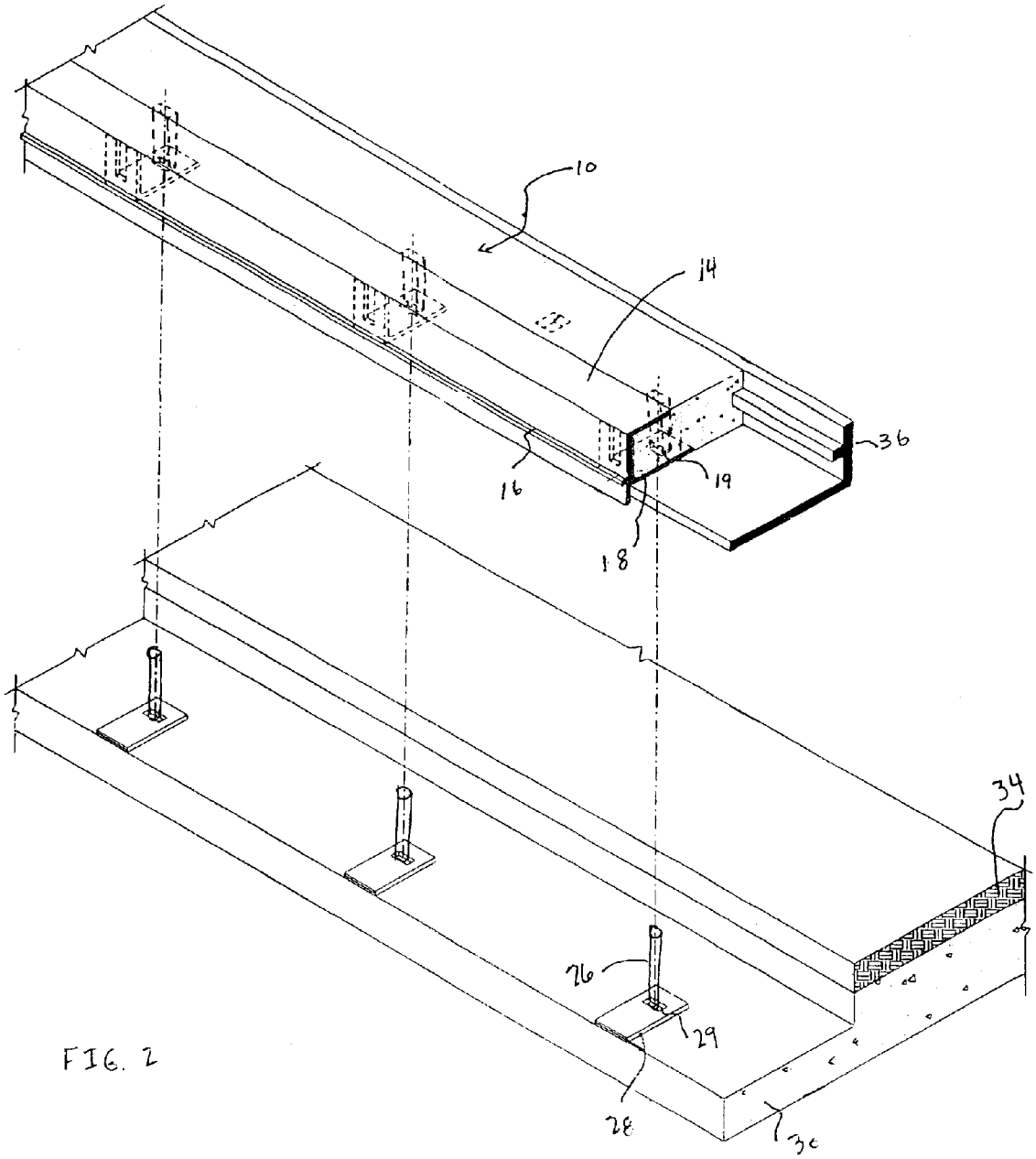
FIG. 2 is a perspective view illustrating the installation of the embodiment shown in FIG. 1 into a recess formed in a concrete slab according to a method of the present invention.

As best shown in FIG. 2, each shim plate 28 preferably includes an aperture 29 dimensioned to receive anchor bolt 26 such that the shim plates may be fixed in place by extending the free end of the bolt through aperture 29. After shim plates 28 have been positioned onto each bolt 26, the precast header may be lowered into the recess by extending the free end of each bolt 26 protruding from concrete slab 30 through the corresponding bore 20 in the header. The precast header 10 may then secured to the concrete slab 30 by screwing a nut onto the free end of each of the bolts until the nut is sufficiently tightened against annular shoulder 22 in each bore 20.

After the precast header is secured to the concrete slab, a viscous, self-leveling bonding agent is poured into the void space between the header and the concrete slab. Preferably, the bonding agent is a polymer concrete or elastomeric concrete substance having a relatively short curing period of approximately one hour or less. As shown in FIGS. 1 and 4, the bonding agent cures and forms a solid material 36 that completely fills the void space between the header and the concrete slab. The bonding agent also provides a strong bond which further secures the header to the concrete slab. It will be understood to one skilled in the art that a bonding agent such as polymer concrete or elastomeric concrete provides a stronger bond between the header and the concrete slab than the concrete-to-concrete bond resulting from forming a concrete header in situ.

Figure 3:
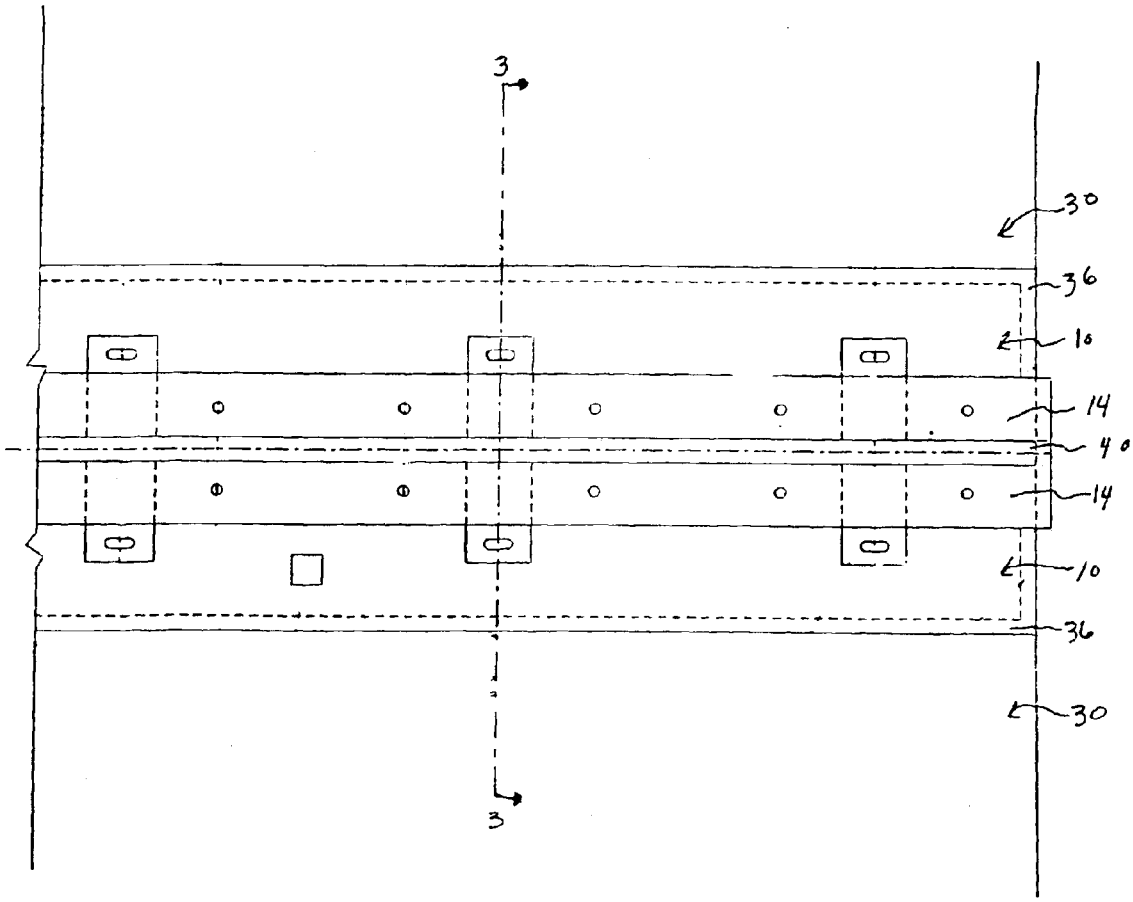
FIG. 3 is a plan view of an embodiment of a joint system for a concrete deck structure according to a method of the present invention.

As illustrated in FIGS. 3 and 4, the method of forming and installing precast concrete headers as described above may be used to install or repair joints between adjacent concrete slabs of a concrete deck structure. The deck structure typically includes several concrete slabs 30 disposed end-to-end. The front and rear ends of each slab include a recess in which a replaceable header 10 is positioned. A gap exists between abutting front and rear ends of adjacent concrete slabs 30 to account for the expansion and contraction of the underlying steel structure. A seal 40 formed of resilient compressible material is connected to each such header and spans the gap therebetween to form a continuous deck surface. The seal 40 also acts to prevent water from leaking through the gap between the adjacent headers.

Figure 5:
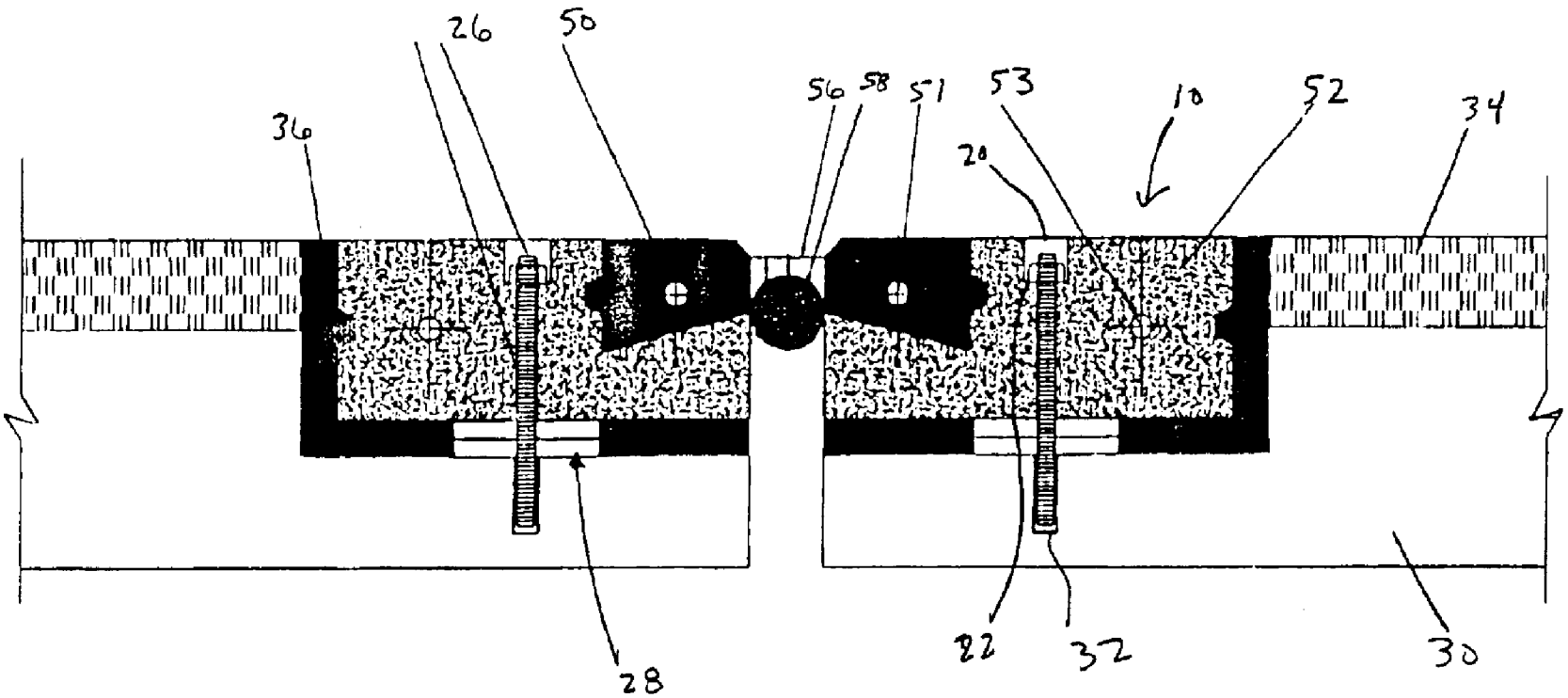
FIG. 5 is a cross-sectional view of a second embodiment of a composite concrete header joint system formed according to a method of the present invention.

A second embodiment of a composite concrete header joint system is shown in FIG. 5. The embodiment shown in FIG. 5 is essentially the same as the embodiment shown in FIG. 1–4 except that this embodiment includes a polymer or elastomeric concrete nosing 50 to protect the front upper edge of the header from deteriorating instead of the armored edge formed by steel angle 14. This embodiment of the header is formed using two steps. First, the main body 52 of the header is formed by pouring concrete (e.g., DP concrete or HP concrete) into a casting form having a void in the shape of nosing 50. In the same manner as describe above with the embodiment shown in FIGS. 1–4, the header shown in FIG. 5 is cast to include at least one bore 20 which extends vertically through the main body 52. Each bore 20 consists of two interconnecting sections having different diameters. The upper section of each bore 20 extends from an opening in the upper surface of main body 52 to an annular shoulder 22. The lower section of each bore 20 has a smaller diameter than the upper section and extends from shoulder 22 to an opening in the bottom surface of main body 52. The main body 52 of the header preferably includes one or two reinforcement bar 53 extending throughout the length of the header. In addition, the upper surface of main body 52 may also be formed with two or more lifting inserts (not shown) to facilitate transportation and installation of the header.

After the concrete of main body 52 is sufficiently cured, nosing 50 is formed by pouring polymer or elastomeric concrete into a casting form fitted about main body 52. As shown in FIG. 5, the interfacing surfaces of nosing 50 and main body 52 may be configured to help secure nosing 50 to main body 52 when it is subjected to the heavy loads imparted by vehicles traveling over the deck structure. Nosing 50 preferably includes a reinforcement bar 51, which extends throughout its length.

The method of installing the joint system shown in FIG. 5 is essentially the same as that described above with regard to the embodiment shown in FIGS. 1–4. First, the precast header 10 is positioned in the recess formed in the underlying concrete slab 30 and a separate hole 32 is drilled in the concrete slab for each bore 20 formed in main body 52. While header 10 is positioned in the recess, the difference in the heights between the top surfaces of header 10 and adjacent asphalt overlay 34 is measured to determine the amount by which the header must be raised to provide a level grade surface with asphalt overlay 34. The header is then removed from the recess and anchor bolts 26 are embedded in holes 32. Shim plates 28 are then inserted over each bolt 26 to adjust the height of the header 10 such that its top surface is at a level grade with the top surface of asphalt overlay 34.

Header 10 is then lowered into the recess such that the free ends of anchor bolts 26 extend through the corresponding bores 20 in the header. The header 10 is then secured to the underlying concrete slab 30 by screwing a nut onto the free end of each anchor bolt 26 until the nut is sufficiently tightened against annular shoulder 22 in each bore 20.

After the header 10 is secured to the concrete slab, a viscous, self, leveling bonding agent, such as a polymer concrete or elastomeric concrete material, is injected into the void space between the header and the concrete slab. The bonding agent cures and forms a solid material 36 that completely fills the void space between the header and the concrete slab.

The joint system shown in FIG. 5 having headers with polymer or elastomeric concrete nosing 50 preferably includes a silicone sealant seal 56 which is supported in place by a backer rod 58 formed of a compressible foam material. This seal is installed by inserted a compressed backer rod 58 between the front surfaces of adjacent headers 10 and by filling the gap extending between the adjacent headers and above backer rod 58 with silicone sealant, which when cured forms seal 56.

It will be understood that the joint system shown in FIG. 5 can also comprise of a header 10 having a unitary body cast of a polymer or elastomeric concrete material. Therefore, instead of separately casting the main body 52 of concrete and the nosing 50 of a polymer or elastomeric concrete material, the entire body header 10 may be cast of a polymer or elastomeric concrete material. Accordingly, the two step process described above for forming header 10 of the embodiment shown in FIG. 5 may be reduced to a one step process by casting the entire body of header 10 of polymer or elastomeric concrete material.

Figure 6:
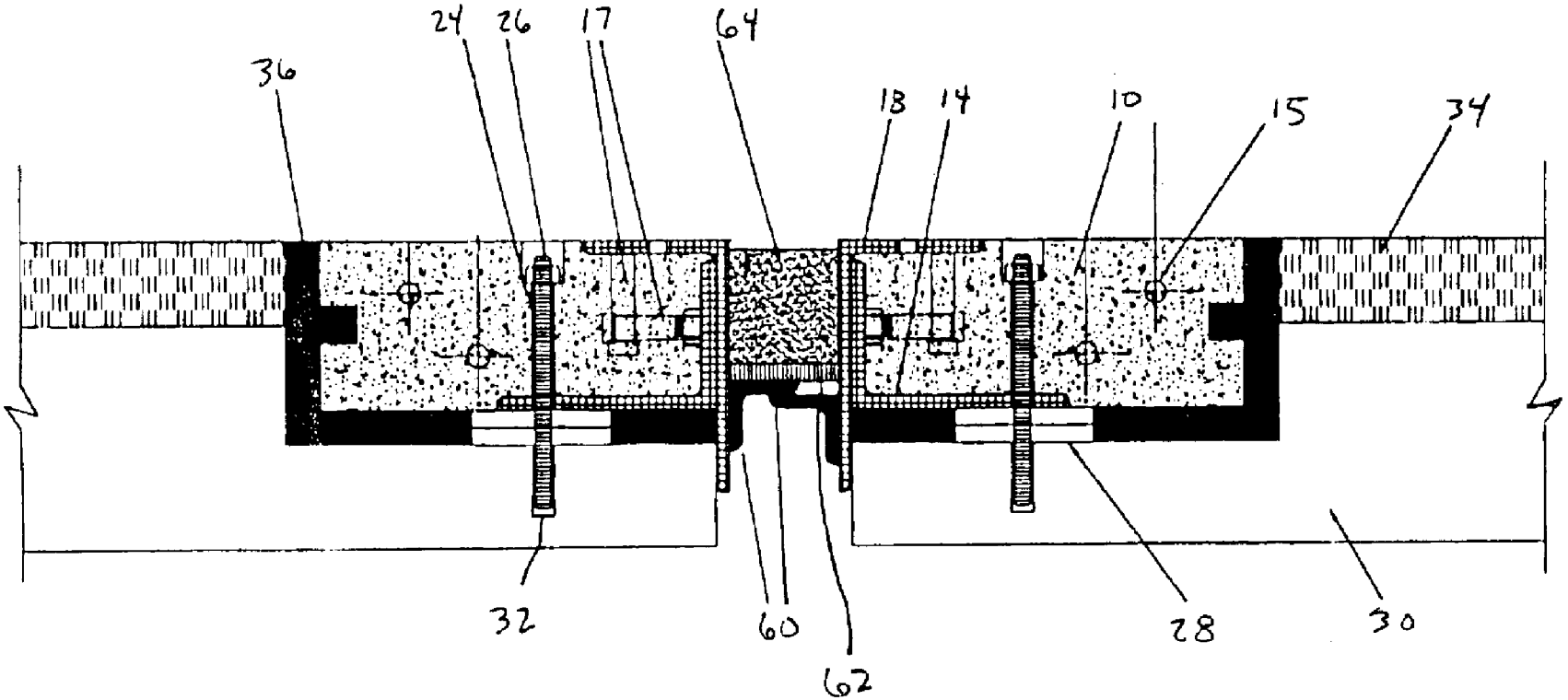
FIG. 6 is a cross-sectional view of the concrete header joint system shown in FIGS. 3 and 4 having an alternate joint seal configuration.

FIG. 6 shows an alternative joint configuration for the basic concrete header joint system of FIGS. 3 and 4. As illustrated in FIG. 6, one or more brace angles 60 are welded to the outer faces of steel angles 14 of each adjacent header 10. Brace angles 60 support a neoprene pad 62 which spans the full length of the gap between the headers. A polymer modified concrete expansion filler is then applied within the gap above pad 62. The expansion filler cures and forms a compressible/expandable seal 64 between the adjacent headers.

It will be understood that the various embodiments of precast headers and joint systems described above may be particularly suitable for specific applications. For example, the embodiment shown in FIG. 5 having a protective nosing 50 formed of a polymer or elastomeric concrete material is preferably used in light traffic applications such as parkways which are not subject to the heavy loads imparted by large commercial trucks. The embodiment shown in FIGS. 1–4 having an armored upper edge may be suitable for a wider range of applications, including heavy traffic roadways subject to the loads imparted by large commercial trucks.

While only a few embodiments have been illustrated and described in connection with the present invention, various modifications and changes to the composite header and method of forming and installing the same will become apparent to those skilled in the art. For illustrative purposes only, the present invention includes the various sub-combinations of materials and configurations set forth in the chart shown in FIG. 7. Other sub-combinations, configurations and materials known to those skilled in the art are also subject to the present invention. All such modifications or changes falling within the scope of the claims are intended to be included therein.

I claim:

1. A method of forming and installing a header of a concrete deck structure having one or more, the concrete deck structure comprising at least one concrete slabs wherein each concrete slab has a top surface, a front end and a back end, comprising the following steps:

(a) precasting a header dimensioned to be received within a recess formed in one of the top surface of and adjacent one of the ends of the concrete slabs;

(b) permitting the precast header to cure;

(c) positioning the precast header in the recess formed in the top surface of the concrete slab such that the top surface of the precast header and the top surface of the concrete slab are at a level grade and time outer face of the header and the adjacent end of the concrete slab are vertically aligned;

(d) securing the precast header to the concrete slab; and (e) pouring a bonding agent into and filling any space between adjacent outer surfaces of the precast header and the concrete slab.

2. The method of claim 1 wherein the header is formed of concrete.

3. The method of claim 2 wherein the bonding agent is polymer concrete.

4. The method of claim 2 wherein the bonding agent is elastomeric concrete.

5. The method of claim 1 wherein the step of precasting the header further comprises forming the precast header with an armored upper edge along the length of the precast header, the upper edge being defined by at least a portion of a top surface and at least a portion of an outer face of the header.

6. The method of claim 1 wherein the step of precasting the header further comprises forming a nosing portion of the header of polymer concrete, the nosing portion comprising at least an upper edge of the header defined by a top surface and an outer face of the header.

7. The method of claim 1 wherein the step of precasting the header further comprises forming a nosing portion of the header of elastomeric concrete, the nosing portion comprising at least an upper edge of the header defined by a top surface and outer face of the header.

8. The method of claim 1 wherein the header is formed of polymer concrete.

9. The method of claim 1 wherein the header is formed of elastomeric concrete.

10. The method of claim 1 wherein the step of positioning the precast header in the recess of the concrete slab comprises inserting a shim plate beneath the precast header.

11. The method of claim 1 wherein the step of securing the precast header to the concrete slab comprises embedding one end of a bolt in the concrete slab and securing the other end of the bolt to the precast header.

12. The method of claim 11 wherein the step of securing the precast header to the concrete slab further comprises:

(a) formed one or more bores extending from the top surface to the bottom surface of the precast header, wherein each bore includes a upper section extending from an opening formed in the top surface of the precast header to an annular shoulder and having a diameter dimensioned for receiving a nut which is threaded onto the bolt and a lower section having a narrower diameter than the upper section and dimensioned for receiving the bolt;

(b) forming one or more holes in tho concrete slab, wherein each hole is aligned with one of the bores formed in the precast header when the precast header is properly positioned in the recess;

(c) embedding one end of the bolt in each hole in the concrete slab and extending the free end of each bolt through a corresponding bore in the precast header; and (d) threading the nut onto the free end of the anchor bolt until the nut abuts the annular shoulder in the bore.

13. The method of claim 12 wherein the lower section of each bore in the precast header is fitted with a metal sleeve, the metal sleeve having an interior passageway dimensioned to receive the anchor bolt.

14. The method of claim 12 further comprising the step of forming one or more support plates on the bottom surface of the concrete header, wherein each support plate includes an aperture dimensioned for receiving the bolt and is aligned with the one of the bores formed in the in the precast header.

15. The method of claim 14 wherein the step of precasting the header further comprises forming the precast header with an armored upper edge extending along the length of the precast header, the upper edge of the header being defined by a top surface and outer face of the header.

16. The method of claim 15 wherein the armored edge is coupled in one or more of the support plates.

17. The method of claim 15 wherein the armored edge and the support plates form a unitary structure.

18. The method of claim 12 wherein the step of positioning the precast header in the recess of the concrete slab comprises placing a shim having an aperture dimensioned to receive the bolt onto the free end of the bolt prior to extending the free end of the bolt through the bore formed in the precast header such that the shim is positioned between the precast header and the concrete slab.

19. A method of forming and installing a joint system for a concrete deck structure, the concrete deck structure comprising a plurality of concrete slabs wherein each concrete slab has a top surface, a front end, a back end, comprising the following steps:

(a) precasting a header dimensioned to be received within a recess formed in the top surface of and adjacent one of the ends of one of the concrete slabs;

(b) permitting the precast header to cure;

(c) positioning the precast header in the recess formed in the top surface of one of the concrete slabs such that the top surface of the precast header and the top surface of the concrete slab are at a level grade and the outer face of the header and the end of the concrete slab are vertically aligned;

(d) securing the precast header to the concrete slab;

(e) pouring a bonding agent into and filling any space between adjacent outer surfaces of the precast header and the concrete slab; and (f) coupling adjacent pairs of precast headers installed in adjacent concrete slabs with a joint to form a continuous deck structure.

20. The method of claim 19 wherein the header is formed of concrete.

21. The method of claim 20 wherein the step of precasting the header further comprises forming the precast header with an armored upper edge along the length of the precast header, the upper edge being defined by at least a portion of a top surface and at least a portion of an outer face of the header.

22. The method of claim 21 wherein the step of coupling adjacent pairs of precast headers with a joint to form a continuous deck structure comprises inserting a compression seal into the gap between opposing outer faces of adjacent headers.

23. The method of claim 22 wherein the compression seal is supported by bars coupled to the opposing outer faces of adjacent headers.

24. The method or claim 21 wherein the step of coupling adjacent pairs of precast headers with a joint to form a continuous deck structure comprises placing a polymer modified concrete material into the gap between opposing outer faces of adjacent headers.

25. The method of claim 24 wherein the compression seal is supported by a neoprene pad which spans the gap between the opposing outer faces of adjacent headers.

26. The method of claim 25 wherein the neoprene pad is supported by one or more braces coupled to the outer face of each adjacent header.

27. The method of claim 19 wherein the step of precasting the header further comprises forming a nosing portion of the header of polymer concrete, the nosing portion comprising at least an upper edge of the header defined by a top surface and an outer face of the header.

28. The method of claim 27 wherein the step of coupling adjacent pairs of precast headers with a joint to form a continuous deck structure comprises placing a sealant into the gap between opposing outer faces of adjacent headers.

29. The method of claim 28 wherein the sealant is supported by a compressible foam material compressed between the opposing outer faces of adjacent headers.

30. The method of claim 19 wherein the step of precasting the header further comprises forming a nosing portion of the header of elastomeric concrete, the nosing portion comprising at least an upper edge of the header defined by a top surface and outer face of the header.

31. The method or claim 30 wherein the step of coupling adjacent pairs of precast headers with a joint to form a continuous deck structure comprises placing a sealant into the gap between opposing outer faces of adjacent headers.

32. The method of claim 31 wherein the sealant is supported by a compressible foam material compressed between the opposing outer faces of adjacent headers.

33. The method of claim 19 wherein the header is formed of polymer concrete.

34. The method of claim 33 wherein the step of coupling adjacent pairs of precast headers with a joint to form a continuous deck structure comprises placing a sealant into the gap between opposing outer faces of adjacent headers.

35. The method of claim 34 wherein the sealant is supported by a compressible foam material compressed between the opposing outer faces of adjacent headers.

36. The method of claim 19 wherein the header is formed of elastomeric concrete.

37. The method of claim 36 wherein the step of coupling adjacent pairs of precast headers with a joint to form a continuous deck structure comprises placing a sealant into the gap between opposing outer faces of adjacent headers.

38. The method of claim 37 wherein the sealant is supported by a compressible foam material compressed between the opposing outer faces of adjacent headers.

39. The method of claim 19 wherein the bonding agent is polymer concrete.

40. The method of claim 19 wherein the bonding agent is elastomeric concrete.

41. The method of claim 19 wherein the step of positioning the precast header in the recess of the concrete slab comprises placing a shim beneath the precast header.

* * * * *

UNITED STATES PATENT AND TRADEMARK OFFICE

CERTIFICATE OF CORRECTION

PATENT NO. : 6,898,910 B2
APPLICATION NO. : 10/357850
DATED : May 31, 2005
INVENTOR(S) : Frank Bellino, Jr.

It is certified that error appears in the above-identified patent and that said Letters Patent is hereby corrected as shown below:

Cover Page, Line (76) Delete "Wallabuc" and insert -- Waccabuc --;
Claim 1 at column 7, line 26, delete "having one or more";
Claim 1 at column 7, line 27, delete "slabs" and insert -- slab --
Claim 1 at column 7, line 31, delete "one of";
Claim 1 at column 7, line 32, delete "slabs" and insert -- slab --;
Claim 1 at column 7, line 37, delete "time" and insert -- the --.

Signed and Sealed this

Nineteenth Day of September, 2006

JON W. DUDAS
*Director of the United States Patent and Trademark Office*